US009315041B2

(12) United States Patent
Moriguchi et al.

(10) Patent No.: US 9,315,041 B2
(45) Date of Patent: Apr. 19, 2016

(54) PRESSURE REGULATING UNIT, LIQUID SUPPLYING APPARATUS, AND LIQUID EJECTING APPARATUS

(71) Applicant: CANON KABUSHIKI KAISHA, Tokyo (JP)

(72) Inventors: Takuto Moriguchi, Kamakura (JP); Shuzo Iwanaga, Kawasaki (JP); Kazuhiro Yamada, Yokohama (JP); Zentaro Tamenaga, Sagamihara (JP); Takatsugu Moriya, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/692,486

(22) Filed: Apr. 21, 2015

(65) Prior Publication Data

US 2015/0314608 A1 Nov. 5, 2015

(30) Foreign Application Priority Data

Apr. 30, 2014 (JP) ..... 2014-093774
Feb. 24, 2015 (JP) ..... 2015-034199

(51) Int. Cl.
*B41J 2/175* (2006.01)
*B41J 2/195* (2006.01)

(52) U.S. Cl.
CPC ..... *B41J 2/17596* (2013.01)

(58) Field of Classification Search
CPC .... B41J 2/175; B41J 2/17513; B41J 2/17523; B41J 2/17556; B41J 2/17596; G05D 16/0644; G05D 16/0655; G05D 16/0683; Y10T 137/7836
USPC ..... 347/7, 85
See application file for complete search history.

(56) References Cited

U.S. PATENT DOCUMENTS

| | | | | |
|---|---|---|---|---|
| 6,382,786 | B2 | 5/2002 | Iwanaga et al. | 347/86 |
| 6,419,349 | B1 | 7/2002 | Iwanaga et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,742,881 | B2 | 6/2004 | Kotaki et al. | 347/86 |
| 7,077,514 | B2 * | 7/2006 | Inoue | B41J 2/17513 347/86 |
| 7,156,507 | B2 | 1/2007 | Aruga et al. | 347/85 |

(Continued)

FOREIGN PATENT DOCUMENTS

JP 3606282 1/2005

OTHER PUBLICATIONS

U.S. Appl. No. 14/692,478, filed Apr. 21, 2014.

(Continued)

*Primary Examiner* — Anh T. N. Vo
(74) *Attorney, Agent, or Firm* — Fitzpatrick, Cella, Harper & Scinto

(57) ABSTRACT

The present invention provides a pressure regulating unit capable of applying a stable pressure so as to supply liquid, a liquid supplying apparatus, and a liquid ejecting apparatus. An ink communication path allows an ink introducing chamber communicating with an ink inlet and a pressure chamber communicating with an ink outlet to communicate with each other. A valve including a valve body and a valve seat adjusts the opening degree of the ink communication path. An urging member applies, to the valve, an urging force that acts in a direction in which the ink communication path is closed and increases according to an decrease in pressure in the ink introducing chamber.

12 Claims, 8 Drawing Sheets

(56) References Cited

U.S. PATENT DOCUMENTS

| | | | | |
|---|---|---|---|---|
| 7,278,718 | B2 * | 10/2007 | Aruga | B41J 2/17523 347/85 |
| 7,556,362 | B2 * | 7/2009 | Akahane | G05D 16/0672 347/40 |
| 8,439,481 | B2 * | 5/2013 | Xie | B41J 2/14016 137/337 |
| 8,480,216 | B2 * | 7/2013 | Matsumoto | B41J 2/16523 347/85 |
| 8,517,518 | B2 * | 8/2013 | Kashu | B41J 2/1404 347/66 |
| 2002/0113853 | A1 | 8/2002 | Hattori et al. | 347/86 |
| 2003/0043241 | A1 | 3/2003 | Hattori et al. | 347/86 |
| 2015/0022596 | A1 | 1/2015 | Aruga et al. | 347/85 |

OTHER PUBLICATIONS

U.S. Appl. No. 14/685,820, filed Apr. 14, 2015.

* cited by examiner

PRESSURE REGULATING UNIT, LIQUID SUPPLYING APPARATUS, AND LIQUID EJECTING APPARATUS

BACKGROUND OF THE INVENTION

1. Field of the Invention

The present invention relates to a pressure regulating unit for regulating pressure to be applied to liquid, a liquid supplying apparatus provided with the pressure regulating unit, and a liquid ejecting apparatus.

2. Description of the Related Art

A liquid ejecting apparatus is exemplified by an inkjet printing apparatus for ejecting ink (liquid) supplied from an ink tank (liquid container) through an inkjet print head (liquid ejection head) so as to print an image on a print medium. In, for example, a business-grade printing apparatus requiring an improved print speed as the printing apparatus, a large quantity of ink is ejected from the print head. In view of this, a large quantity of ink is required to be supplied to the print head. For this purpose, ink contained in the ink tank is pressurized by a pump or the like, and then, the pressurized ink need be supplied (pressure-supplied). In the meantime, ink, to which a negative pressure is applied, need be supplied to the print head for ejecting the ink from an ejection port in order to suppress the leakage of the ink from the ejection port.

Japanese Patent No. 3606282 discloses an apparatus for regulating the pressure of ink, the apparatus being provided with a pressure regulating unit on a supply path, through which the ink is supplied to a print head. The pressure regulating unit is adapted to regulate the pressure of ink to be pressure-supplied, to apply a negative pressure to the ink, and then, to supply the ink to the print head. The negative pressure is applied to the ink to be supplied to the print head so as to form a meniscus of the ink at an ejection port. The pressure regulating unit opens or closes a valve disposed on the supply path according to the negative pressure inside of the print head, the negative pressure being varied according to the ejection of the ink, in order to stabilize the negative pressure of the ink staying in the print head.

The pressure regulating unit disclosed in Japanese Patent No. 3606282 is configured such that, for example, in a case where ink is no longer pressure-supplied during the stoppage of a printing apparatus and during the exchange of the print head, a negative pressure to be applied to the ink is regulated to a low level. Therefore, the negative pressure to be applied to the ink staying in the print head becomes low during the stoppage of the printing apparatus and during the exchange of the print head, thus causing a possibility of leakage of the ink from the ejection port.

SUMMARY OF THE INVENTION

The present invention provides a pressure regulating unit capable of applying a stable pressure to supply liquid, a liquid supplying apparatus, and a liquid ejecting apparatus.

In the first aspect of the present invention, there is provided a pressure regulating unit provided on a supply path communicating between a liquid container for containing liquid and a liquid ejection head for ejecting liquid, the unit comprising:

a first pressure chamber capable of introducing liquid;

a second pressure chamber capable of leading out the liquid;

a communication path that allows the first pressure chamber and the second pressure chamber to communicate with each other;

a valve capable of adjusting an opening degree of the communication path; and an urging unit configured to apply an urging force to the valve, the urging force acting in a direction in which the communication path is closed and increasing according to a decrease in pressure in the first pressure chamber.

In the second aspect of the present invention, there is provided a liquid supplying apparatus comprising: the pressure regulating unit according to claim 1; and a liquid container for containing liquid.

In the third aspect of the present invention, there is provided a liquid ejecting apparatus comprising: the liquid supplying apparatus according to claim 7; and a liquid ejection head capable of ejecting liquid to be supplied from the liquid supplying apparatus.

In the fourth aspect of the present invention, there is provided an inkjet printing apparatus comprising: the liquid supplying apparatus according to claim 7, the liquid supplying apparatus supplying ink serving as liquid; an inkjet printing head configured to eject the ink to be supplied from the liquid supplying apparatus; and a moving unit configured to relatively move the inkjet printing head and a print medium.

According to the present invention, it is possible to stably maintain the pressure of the second pressure chamber by applying the urging force to the valve for adjusting the opening degree of the communication path between the first pressure chamber and the second pressure chamber, the urging force acting in the direction in which the communication path is closed and changing according to the pressure of the first pressure chamber. In a case of supplying the liquid from the second pressure chamber to the liquid ejection head, it is possible to maintain the negative pressure of the liquid contained in the liquid ejection head in a predetermined range to suppress the leakage of the liquid from the liquid ejection head.

Further features of the present invention will become apparent from the following description of exemplary embodiments (with reference to the attached drawings).

DESCRIPTION OF THE EMBODIMENTS

Figure 1:
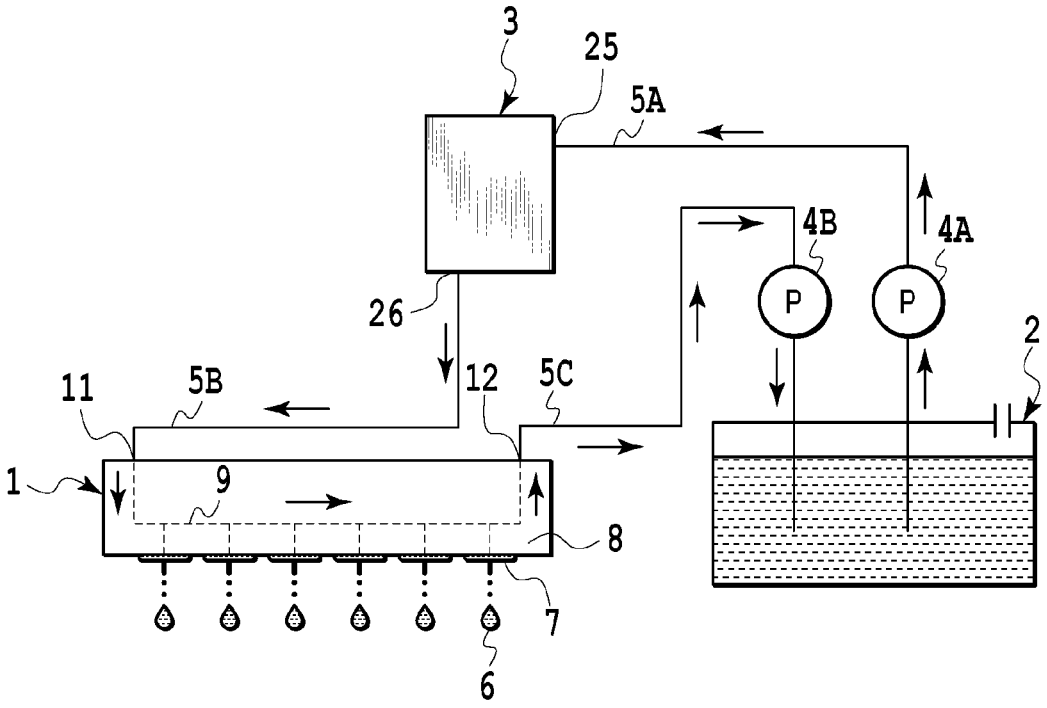
FIG. 1 is a view showing a configuration of an ink supplying apparatus in an embodiment of the present invention.

An embodiment of the present invention will be described with reference to the attached drawings. A liquid supplying apparatus in the present embodiment is exemplified by an ink supplying apparatus for supplying ink to an inkjet print head (liquid ejection head) capable of ejecting ink (liquid). The ink supplying apparatus in the present embodiment is provided for an inkjet printing apparatus (liquid ejecting apparatus). FIG. 1 is a view used in explaining the basic configuration of the ink supplying apparatus.

The ink supplying apparatus in the present embodiment includes a print head 1 capable of ejecting ink, an ink tank (liquid container) 2, and a pressure regulating unit 3. These members are connected to each other via ink tubes 5 (5A, 5B, and 5C). The pressure regulating unit 3 is provided on an ink supply path (liquid supply path) between the print head 1 and the ink tank 2. The print head 1 is provided with a print element board 7 including a plurality of ejection ports and a plurality of ejection energy generating elements, and thus, is configured to eject an ink droplet (liquid droplet) 6 from the ejection port by utilizing ejection energy generated by the corresponding ejection energy generating element. An electrothermal transducer (heater), a piezoelectric element, or the like may be used as the ejection energy generating element. In the case of the use of the electrothermal transducer, ink is foamed by the generated heat, and thus, the ink droplet 6 can be ejected from the ejection port by utilizing the foaming energy.

An inkjet printing apparatus provided with the above-described ink supplying apparatus includes a moving mechanism for relatively moving the print head 1 and a print medium and a control unit for ejecting the ink droplet 6 from the print head 1 based on image data. The printing apparatus relatively moves the print head 1 and a print medium while ejecting the ink droplet 6 from the print head 1 so as to print an image on the print medium. The above-described printing apparatus may be of either a full line type or a serial scan type. The printing apparatus of a full line type sequentially conveys the print medium while ejecting ink from the print head so as to print an image. In the meantime, the printing apparatus of a serial scan type prints an image by repeating an operation for moving the print head in a main scanning direction while ejecting ink and an operation for conveying the print medium in a sub scanning direction crossing the main scanning direction.

Figure 8:
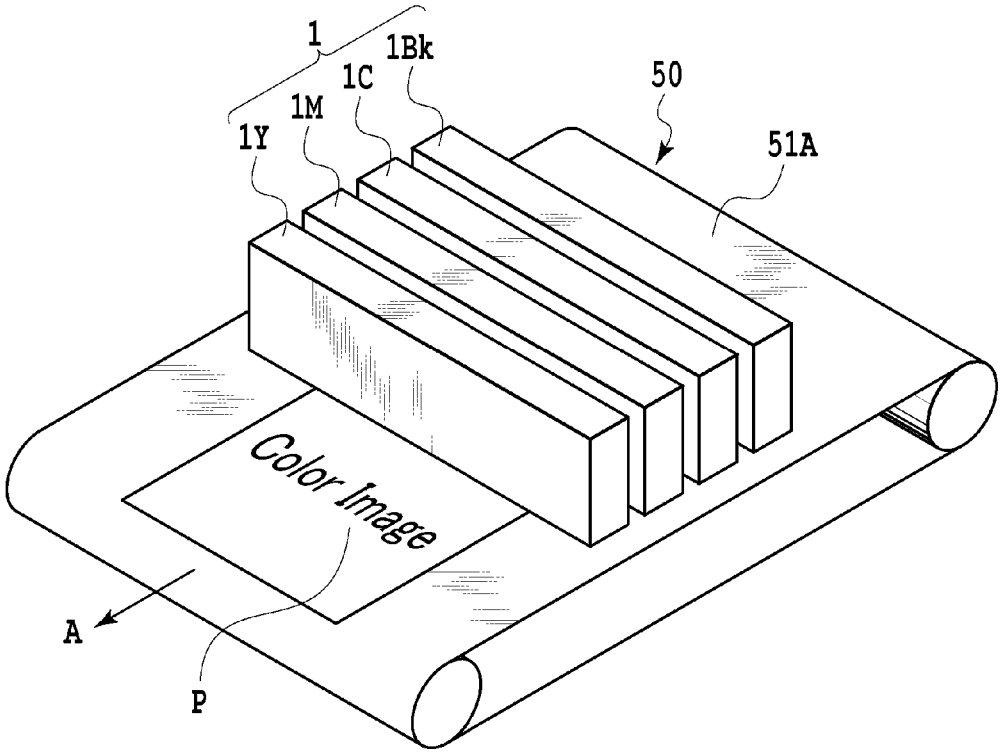
FIG. 8 is a view schematically showing an inkjet printing apparatus in which the ink supplying apparatus shown in FIG. 1 may be arranged.

FIG. 8 is a schematically perspective view used in explaining a specific constitutional example of an inkjet printing apparatus of a full line type. The printing apparatus in the present embodiment is provided with print heads 1 (1Bk, 1C, 1M, and 1Y) for ejecting black (Bk), cyan (C), magenta (M), and yellow (Y) inks. A print medium P is conveyed in a direction indicated by an arrow A by a conveyance mechanism 50 using a conveyance belt 51A. In order to supply the inks corresponding to the print heads 1, respectively, each of the print heads 1 is provided with the ink supplying apparatus shown in FIG. 1. A plurality of ejection ports capable of ejecting the ink are formed at each of the print heads 1. These ejection ports form an ejection port array extending in a direction crossing (in the present embodiment, perpendicular to) the conveyance direction (the direction indicated by the arrow A) of the print medium P. While conveying the print medium P in the direction indicated by the arrow A by the conveyance mechanism 50, the inks are ejected from the print heads 1, so that a color image can be printed on the print medium P.

In FIG. 1, the ink tank 2 and the pressure regulating unit 3 communicate with each other via the ink tube 5A. Driving a pressurizing pump 4A allows the ink contained in the ink tank 2 to be fed to the pressure regulating unit 3. The pressure regulating unit 3 and the print head 1 communicate with each other via the ink tube 5B. Therefore, the ink whose pressure is regulated in the pressure regulating unit 3 is supplied to the print head 1. One end of the ink tube 5B communicates with an ink inlet 11 formed at the print head 1, and thus, the ink having a negative pressure applied thereto, as will be described later, is fed to an ink channel 9 inside of the print head 1 from the pressure regulating unit 3. The ink staying in the ink channel 9 is fed to the print element board 7, and then, is ejected from the ejection port in the form of the ink droplet 6 by the ejection energy generating element such as an electrothermal transducer. The ink channel 9 communicates with an ink outlet 12 that communicates with the ink tank 2 via the ink tube 5C. Driving a suction pump 4B allows the ink staying in the print head 1 to be sucked and fed to the ink tank 2.

In the print head 1 in the present embodiment, the plurality of print element boards 7 are arranged in a zigzag on the base board 8, thus configuring an elongate print head for use in the inkjet printing apparatus of a so-called full line type. The above-described print head 1 is suitable for a business-grade printing apparatus that requires printing a wide image at a high speed. The number of print element boards 7 to be arranged is not limited to six, like the present embodiment. A wider image can be printed by increasing the number of print element boards 7 to be arranged. For example, with the above-described print head 1, as wide an image as 4 to 12 inches can be printed at a high speed.

Figure 2A:
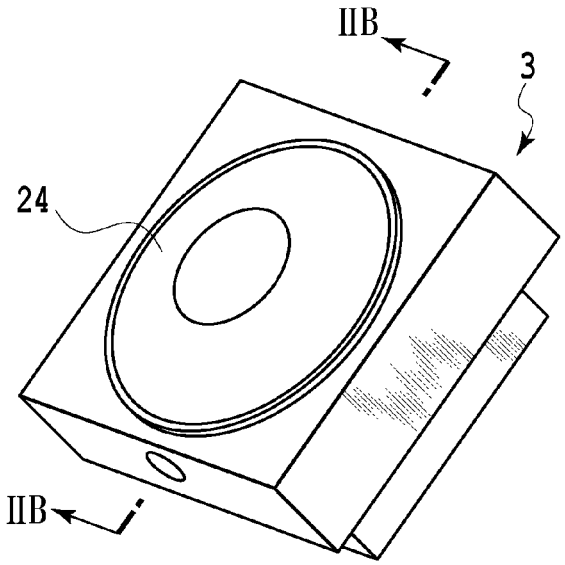
FIG. 2A is a perspective view showing a pressure regulating unit shown in FIG. 1
Figure 2B:
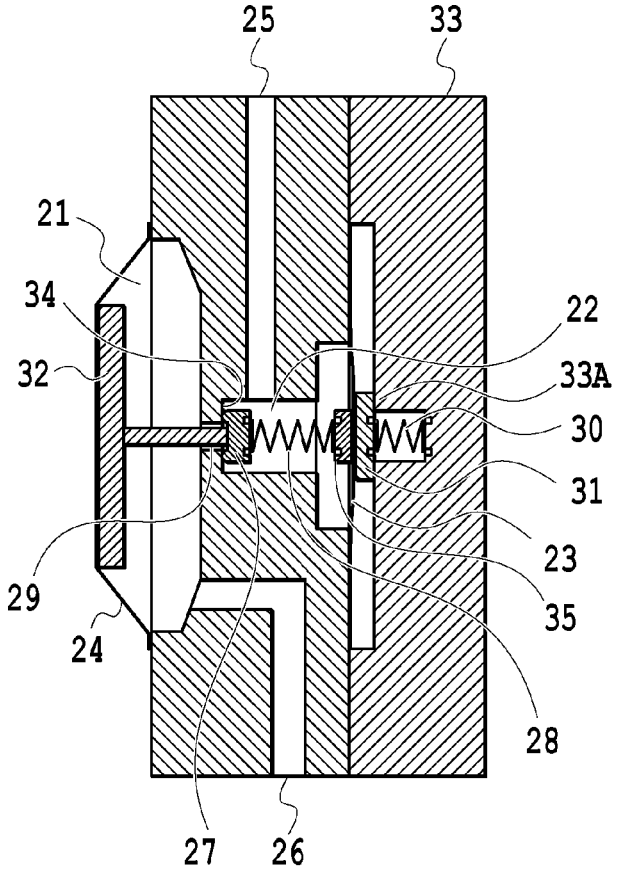
FIG. 2B is a cross-sectional view taken along a line of IIB-IIB of FIG. 2A.

FIG. 2A is a perspective view showing the pressure regulating unit 3 and FIG. 2B is a cross-sectional view taken along a line of IIB-IIB of FIG. 2A.

In the pressure regulating unit 3, a part of a pressure chamber (second pressure chamber) 21 capable of leading out ink is formed of a film (second flexible member) 24 formed of a flexible film. Further, a part of an ink introducing chamber (first pressure chamber) 22 capable of introducing ink is formed of a film (first flexible member) 23 formed of a flexible film. These films 23 and 24 may be formed in various planar shapes such as a circle, an ellipse, and a rectangle. At a main body of the pressure regulating unit 3, an ink inlet 25 communicating with the ink tube 5A and an ink outlet 26 communicating with the ink tube 5B are formed. The ink inlet 25 communicates with the ink introducing chamber 22 and the ink outlet 26 communicates with the pressure chamber 21. Ink fed from the ink tank 2 via the ink tube 5A is supplied to the print head 1 through the ink inlet 25, the ink introducing chamber 22, an ink communication path 29, the pressure chamber 21, and the ink outlet 26.

A pressure plate 32 is disposed at an inner surface of the film 24 positioned at the inside of the pressure chamber 21. On the ink communication path 29 allowing the pressure chamber 21 and the ink introducing chamber 22 to communicate with each other, a valve body 27 and a valve seat 34 constituting a valve are disposed. The valve body 27 that can be brought into or out of contact with the valve seat 34 is connected to the pressure plate 32 and the valve seat 34 is formed at an opening of the ink communication path 29. Further, the valve body 27 is urged in a direction facing to the valve seat 34 by a second urging member 28 (leftward in FIG. 2B). In a case where the valve body 27 is brought into close contact with the valve seat 34, it closes the ink communication path 29. The urging member 28 is interposed between the valve body 27 and a spring bearing member 35 attached to the film 23 in such a manner as to be positioned at the inside of the ink introducing chamber 22. Other than a spring such as a coil spring, like the present embodiment, various resilient members such as a diaphragm may be used as the urging member 28. Moreover, the valve is not limited to a configuration comprising the valve body 27 and the valve seat 34, like the present embodiment, and may be configured such that the opening degree of the ink communication path 29 may be adjusted to change ink flow resistance.

At an outer surface of the film 23 positioned at the outside of the ink introducing chamber 22, a pressure plate 31 is disposed. A first urging member 30 urges the film 23 in a direction inward of the ink introducing chamber 22 (leftward in FIG. 2B) via the pressure plate 31. Further, the movement position of the pressure plate 31 to the right in FIG. 2B is restricted by abutting the pressure plate 31 on a position restricting portion 33A of a restricting member 33. Other than a spring such as a coil spring, like the present embodiment, various resilient members such as a diaphragm may be used as the urging member 30. Further, the tension of the film 23 may also be used instead of the urging force of the urging member 30.

The urging force of the first urging member 30 for urging the film 23 leftward in FIG. 2B is smaller than the force in a case where the pressure plate 31 is moved rightward in FIG. 2B by the pressure of ink staying in the ink introducing chamber 22 pressurized by the driving of the pressurizing pump 4A. Therefore, during the driving of the pressurizing pump 4A, the pressure plate 31 resists the urging force of the urging member 30 to be moved rightward in FIG. 2B by the pressure of the ink staying in the ink introducing chamber 22 to thereby abut on the position restricting portion 33A of the restricting member 33.

Next, the operation of the pressure regulating unit 3 will be explained.

Figure 3B:
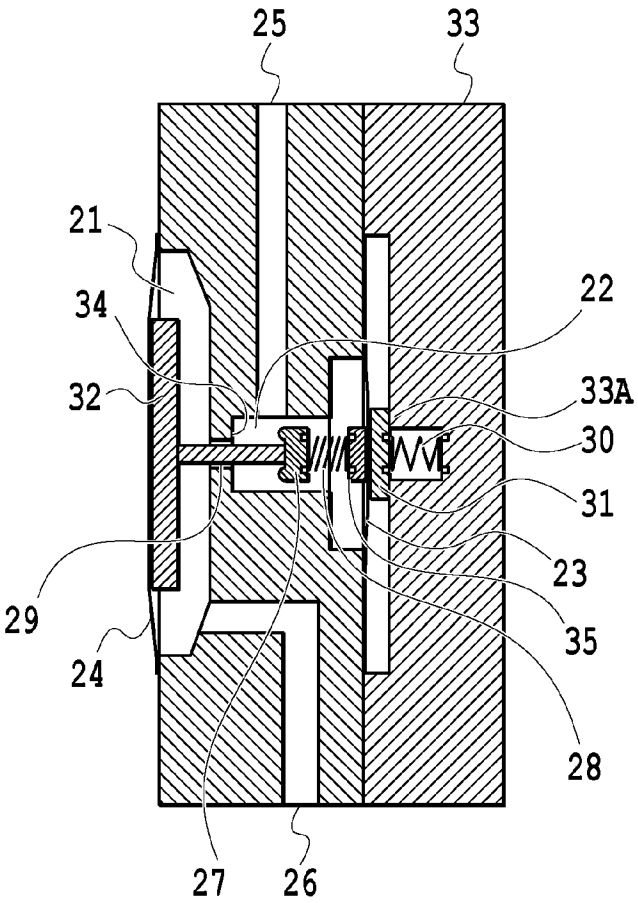
FIGS. 3A and 3B each are cross-sectional views used in explaining the operation of the pressure regulating unit shown in FIGS. 2A and 2B.
Figure 3A:
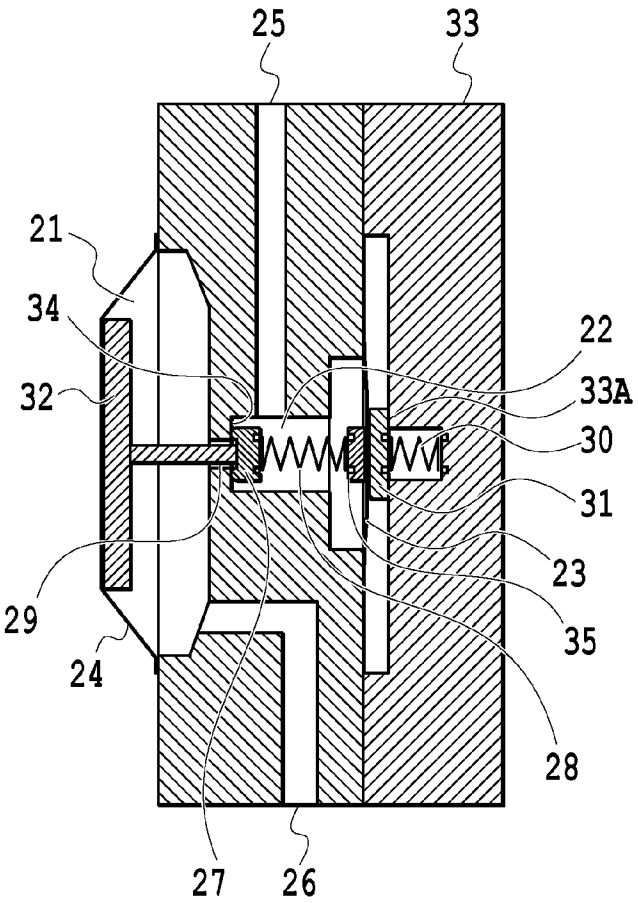

In a case of the low negative pressure inside of the pressure chamber 21, the valve body 27 is brought into close contact with the valve seat 34, thus closing the ink communication path 29, as shown in FIG. 3A. The negative pressure inside of the pressure chamber 21 is increased according to the ejection of the ink from the print head 1, that is, the consumption of the ink. In a case where the negative pressure inside of the pressure chamber 21 becomes a predetermined value or higher, the film 24 is displaced rightward in FIG. 3*b* together with the pressure plate 32 and the valve body 27 against the urging force of the second urging member 28, as shown in FIG. 3B, so that the valve body 27 separates from the valve seat 34 to open the ink communication path 29. In this manner, the ink pressurized by the pressurizing pump 4A is supplied to the print head 1 through the ink inlet 25, the ink introducing chamber 22, the ink communication path 29, the pressure chamber 21, and the ink outlet 26.

Figure 4:
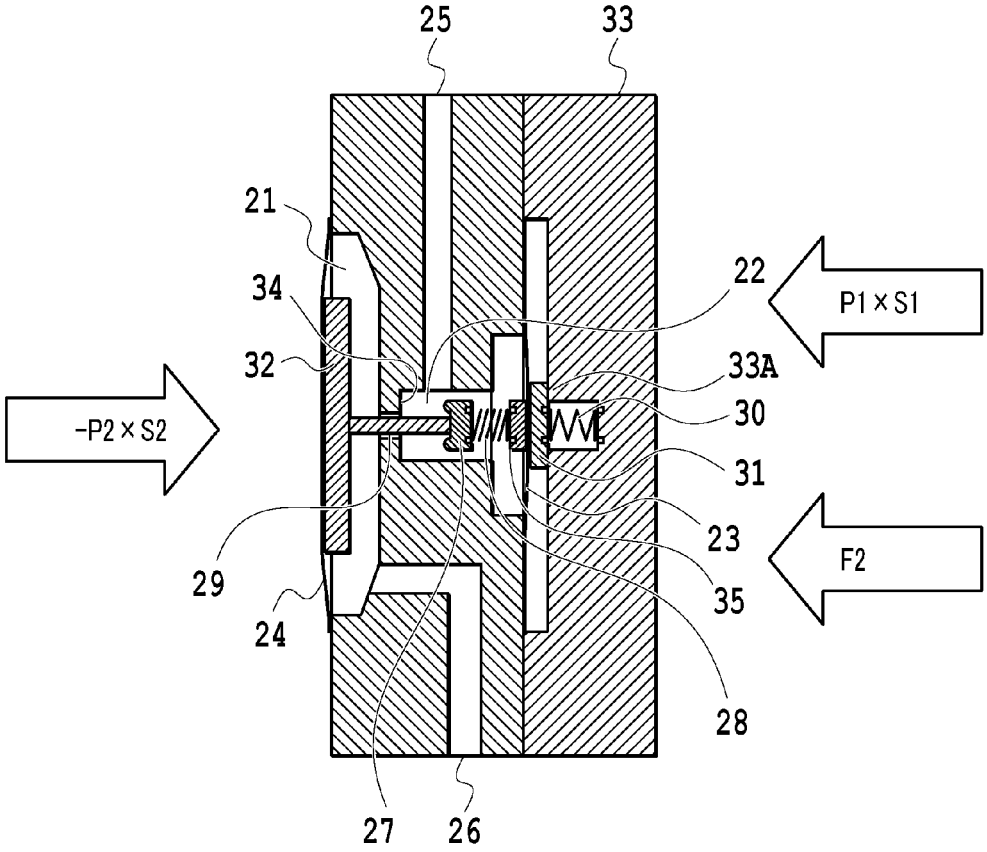
FIG. 4 is a cross-sectional view used in explaining the operation of the pressure regulating unit shown in FIGS. 2A and 2B during the driving of a pressurizing pump.

During the driving of the pressurizing pump 4A, that is, in the state in which the pressurized ink is supplied into the ink introducing chamber 2, when a force of the valve body 27 for opening the ink communication path 29 and a force of the valve body 27 for closing the ink communication path 29 balance with each other, the following equation (1) is established. As shown in FIG. 4, the force in a direction in which the valve body 27 closes the ink communication path 29 is considered as a plus and the force in a direction in which the valve body 27 opens the ink communication path 29 is considered as a path 29 is considered as a minus.

$$-P2\times S2=P1\times S1+F2 \qquad \text{Equation (1)}$$

P2 denotes a pressure inside of the pressure chamber 21, P1 denotes a pressure of the ink introducing chamber 22, and S2 denotes an area of the pressure plate 32 inside of the pressure chamber 21. S1 denotes an area of a surface of the valve body 27 in the inside of the ink introducing chamber 22, and further, a surface parallel to the pressure plate 32. F2 denotes an urging force of the second urging member 28. The pressure plate 31 is, as shown in FIG. 4, moved rightward in FIG. 4 by the ink staying in the pressurized ink introducing chamber 22 and abuts on the position restricting portion 33A of the restricting member 33, and thus the urging force of the first urging member 30 does not act on the valve body 27.

The above-described equation (1) may be changed into the following equation (2).

$$P2=-(P1\times S1)/S2-F2/S2 \qquad \text{Equation (2)}$$

Figure 5:
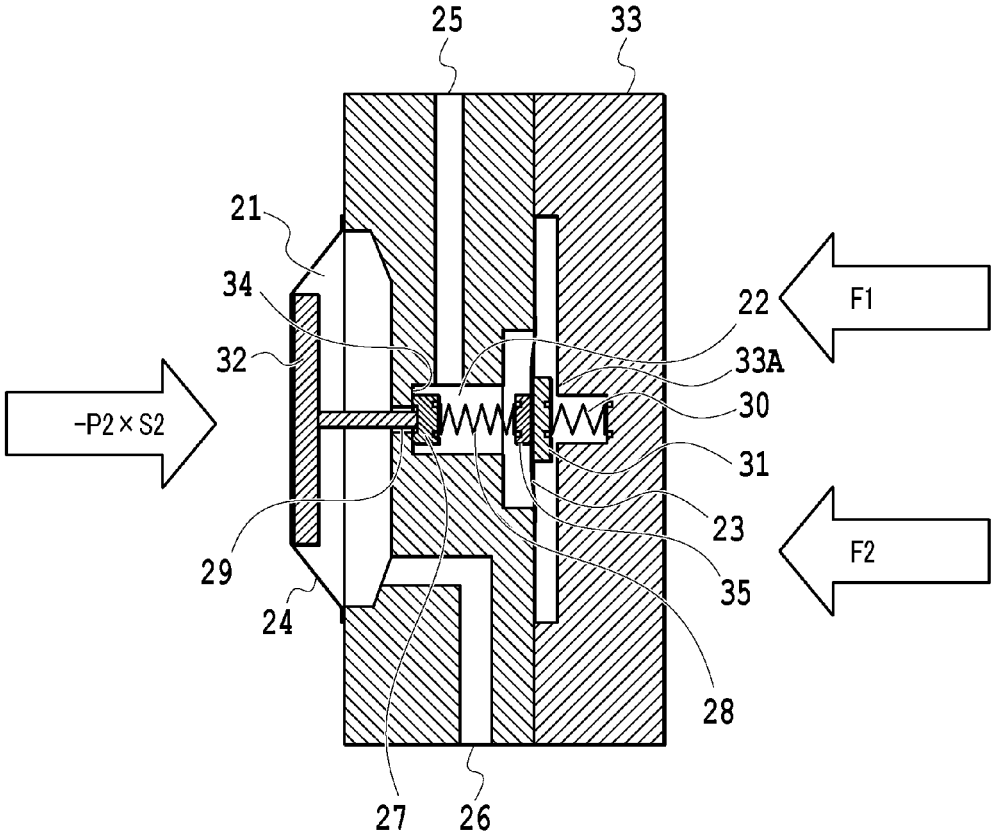
FIG. 5 is a cross-sectional view used in explaining the operation of the pressure regulating unit shown in FIGS. 2A and 2B during the stoppage of the pressurizing pump.

In the meantime, during the stoppage of the pressurizing pump 4A, that is, in a case where the ink staying in the ink introducing chamber 22 is not pressurized, when a force of the valve body 27 for opening the ink communication path 29 and a force of the valve body 27 for closing the ink communication path 29 balance with each other, the following equation (3) is established. As shown in FIG. 5, the force in the direction in which the valve body 27 closes the ink communication path 29 is considered as a plus and the force in the direction in which the valve body 27 opens the ink communication path 29 is considered as a minus.

$$-P2\times S2=F1+F2 \qquad \text{Equation (3)}$$

F1 denotes an urging force of the first urging member 30. The pressure plate 31 is, as shown in FIG. 5, moved leftward in FIG. 5 by the urging force F1 of the first urging member 30, and thus the urging force F1 acts on the valve body 27.

The above-described equation (3) may be changed into the following equation (4).

$$P2=-F1/S2-F2/S2 \qquad \text{Equation (4)}$$

Figure 6:
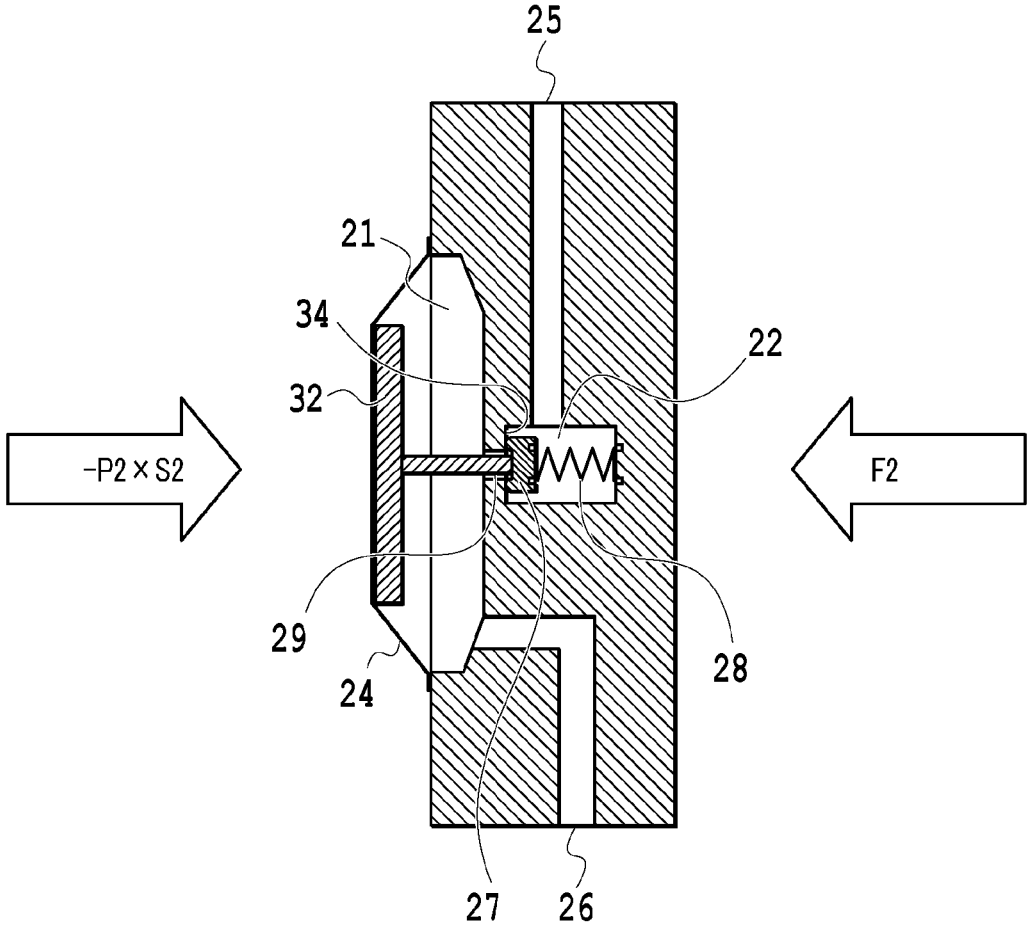
FIG. 6 is a cross-sectional view used in explaining a pressure regulating unit as a Comparative Example.

FIG. 6 is a cross-sectional view of a pressure regulating unit as a Comparative Example and is such configured that the first urging member 30, the pressure plate 31, and the restricting member 33 were detached from the pressure regulating unit 3 of the above-described present embodiment. Like the pressure regulating unit 3 of the present embodiment, the pressure regulating unit as this Comparative Example is provided for the ink supplying apparatus shown in FIG. 1. In the ink supplying apparatus, during the stoppage of the pressurizing pump 4A, in a case where a force of the valve body 27 for opening the ink communication path 29 and a force of the valve body 27 for closing the ink communication path 29 balance with each other, the following equation (5) is established. As shown in FIG. 6, the force in a direction in which the valve body 27 closes the ink communication path 29 is considered as a plus and the force in a direction in which the valve body 27 opens the ink communication path 29 is considered as a minus.

$$-P2\times S2=F2 \qquad \text{Equation (5)}$$

The above-described equation (5) may be changed into the following equation (6).

$$P2=-F2/S2 \qquad \text{Equation (6)}$$

In the above-described equation (6), the pressure P2 of the pressure chamber 21 during the stoppage of the pressurizing pump 4A depends on the urging force F2 of the second urging member 28, and no force that generates a negative pressure is present other than the urging force F2. Therefore, the pressure force P2 in the pressure chamber 21 becomes a negative pressure lower than the pressure P2 in the above-described equation (2) by {(P1×S1)/S2)} and becomes a negative pressure lower than the pressure P2 in the above-described equation (4) by (F1/S2). Accordingly, in the case of the pressure regulating unit as the Comparative Example shown in FIG. 6, a negative pressure to be applied to the ink staying in the print head 1 becomes insufficient as the negative pressure inside of the pressure chamber 21 becomes low, thereby causing a possibility of the leakage of ink from the ejection port of the print head 1.

In the case where the pressurizing pump 4A is stopped and pressurized ink is not supplied into the ink introducing chamber 22, the pressure regulating unit 3 in the present embodiment can maintain the pressure P2 inside of the pressure chamber 21 to a negative pressure of a predetermined value or higher, like the above-described equation (4). As a result, a reliable ink supplying apparatus and printing apparatus can be provided by applying the negative pressure of the predetermined value or higher to the ink staying in the ejection port of the print head 1 communicating with the pressure chamber 21 to suppress the leakage of ink from the ejection port. The pressurizing pump 4A stops, for example, during the stoppage of the ink supplying apparatus and during the exchange of the print head 1.

Example 1

In Example 1, the pressure regulating unit 3 shown in FIG. 2A is fabricated under the condition shown in Table (1) below, thus configuring the ink supplying apparatus shown in FIG. 1. In the ink supplying apparatus, a pressure of ink staying in the pressure chamber 21 in a case where the pressurizing pump 4A is driven to pressurize ink at 50 kPa (a pressure during pressurization) and a pressure of ink staying in the pressure chamber 21 in a case of stopping the pressurizing pump 4A (a pressure during the stoppage of pressurization) are shown in Table (2) below.

TABLE (1)

| | Example 1 | Comparative Example |
|---|---|---|
| Area of valve ($mm^2$) | 4.5 | 4.5 |
| Area of negative pressure plate ($mm^2$) | 530 | 530 |
| Spring constant of valve spring (gf/mm) | 4.2 | 4.2 |
| Initial urging force of valve spring (gf) | 51 | 51 |
| Urging force of urging member (gf) | 50 | 0 |

TABLE (2)

| | Example 1 | Example 2 | Comparative Example |
|---|---|---|---|
| During pressurization: 50 kPa (mmAq) | −97 | −97 | −97 |
| During stoppage of pressurization: 0 kPa (mmAq) | −94 | −92 | −51 |

In Comparative Example, a pressure regulating unit 3 shown in FIG. 6 is fabricated under the condition of Table (1), and then, it is provided for the ink supplying apparatus shown in FIG. 1. In the ink supplying apparatus, a pressure of ink staying in the pressure chamber 21 in a case where the pressurizing pump 4A is driven to pressurize ink at 50 kPa (a pressure during pressurization) and a pressure of ink staying in the pressure chamber 21 in a case of stopping the pressurizing pump 4A (a pressure during the stoppage of pressurization) are shown in Table (2).

As is obvious from Table (2), in the pressure regulating unit 3 of Example 1, the negative pressure inside of the pressure chamber 21 is increased to a certain level by urging forces of the first and second urging members 28 and 30 during the stoppage of the pressurizing pump 4A. Accordingly, reliability can be improved by suppressing the leakage of the ink from the ejection port of the print head 1 during the stoppage of the ink supplying apparatus.

In contrast, in the pressure regulating unit in Comparative Example, as is obvious from Table (2), the negative pressure inside of the pressure chamber 21 during the stoppage of the pressurizing pump 4A is decreased to about half of the negative pressure inside of the pressure chamber 21 during pressurization of ink by the pressurizing pump 4A. This is because there is no force that produces a negative pressure other than the urging force by the first urging member 28. Therefore, a sufficient negative pressure is not exerted on the ink staying in the ejection port of the print head 1 during the stoppage of the pressurizing pump 4A, thus causing a possibility of the leakage of the ink from the ejection port.

Example 2

Figure 7:
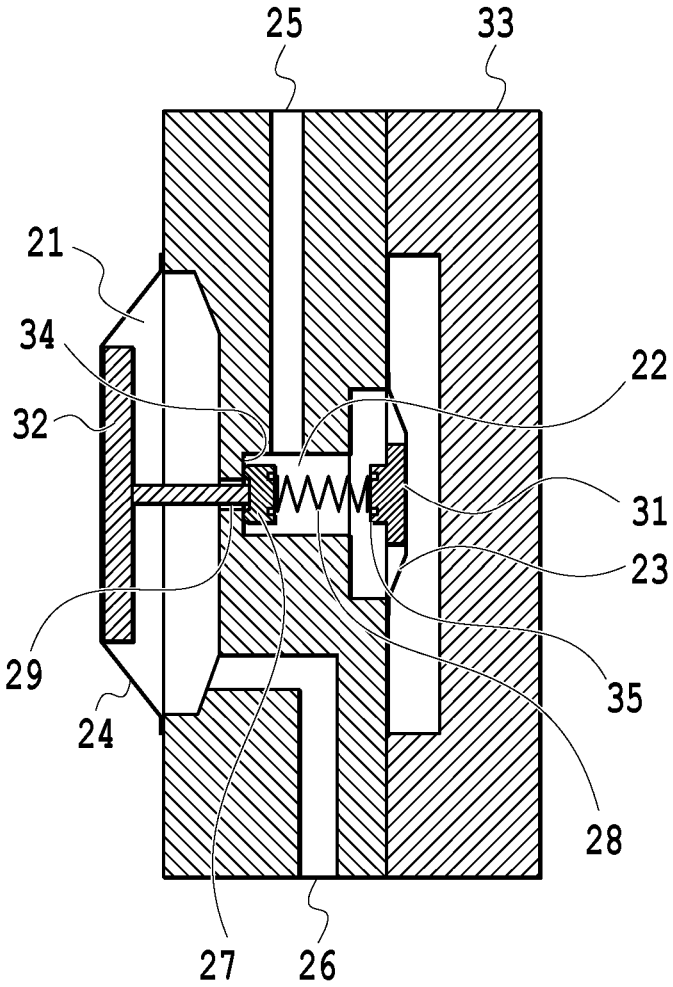
FIG. 7 is a cross-sectional view used in explaining a pressure regulating unit in Embodiment 2 of the present invention.

In Example 2, a pressure regulating unit 3 as shown in FIG. 7 is fabricated under the condition shown in Table (3) below. The pressure regulating unit 3 is configured to use a tension of the film 23 instead of the urging force of the first urging member 30. That is to say, the film 23 is configured to function as the first urging member 30. The ink supplying apparatus shown in FIG. 1 is configured by using such a pressure regulating unit. In the ink supplying apparatus, a pressure of ink staying in the pressure chamber 21 in a case where the pressurizing pump 4A is driven to pressurize ink at 50 kPa (a pressure during pressurization) and a pressure of ink staying in the pressure chamber 21 in a case of stopping the pressurizing pump 4A (a pressure during the stoppage of pressurization) are shown in Table (2).

TABLE (3)

| | Example 2 |
|---|---|
| Area of valve (mm ) | 4.5 |
| Area of negative pressure plate ($mm^2$) | 530 |
| Spring constant of valve spring (gf/mm) | 4.2 |
| Initial urging force of valve spring (gf) | 51 |
| Tension of film (gf) | 45 |

As is obvious from Table (2), in the pressure regulating unit 3 of Example 2, the negative pressure inside of the pressure chamber 21 is increased to a certain level by the urging forces of the film 23 and the second urging member 28 during the stoppage of the pressurizing pump 4A, like Example 1. Accordingly, reliability can be improved by suppressing the leakage of the ink from the ejection port of the print head 1 during the stoppage of the ink supplying apparatus.

The present invention is widely applicable to a pressure regulating unit for regulating the pressure of each of various kinds of liquids, a liquid supplying apparatus for supplying each of various kinds of liquids, and a liquid ejecting apparatus capable of ejecting each of various kinds of liquids. Furthermore, the present invention is applicable to a liquid ejecting apparatus for applying various kinds of processing (such as printing, processing, coating, irradiating, reading, and inspecting) to each of various kinds of mediums (e.g., a sheet) by using a liquid ejecting head capable of ejecting liquid. Examples of the medium (including a print medium) include various mediums such as paper, plastic, a film, fabric, metal, and a flexible board, to which liquid such as ink is applied, whatever the material may be.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-093774, filed Apr. 30, 2014, and 2015-034199, filed Feb. 24, 2015, which are hereby incorporated by reference wherein in their entirety.

What is claimed is:

1. A pressure regulating unit provided on a supply path communicating between a liquid container for containing liquid and a liquid ejection head for ejecting liquid, the unit comprising:

a first pressure chamber capable of introducing liquid;

a second pressure chamber capable of leading out the liquid;

a communication path that allows the first pressure chamber and the second pressure chamber to communicate with each other;

a valve capable of adjusting an opening degree of the communication path; and an urging unit configured to apply an urging force to the valve, the urging force acting in a direction in which the communication path is closed and increasing according to a decrease in pressure in the first pressure chamber, wherein the urging unit includes:

a first urging member configured to apply a predetermined first urging force that acts in the direction in which the communication path is closed and increases according to a decrease in pressure in the first pressure chamber; and a second urging member configured to apply a second urging force to the valve, the second urging force acting in the direction in which the communication path is closed, wherein at least a part of the first pressure chamber is formed of a first flexible member that is displaced according to the pressure in the first pressure chamber, and the first urging force of the first urging member to be applied to the valve changes according to displacement of the first flexible member.

2. The pressure regulating unit according to claim 1, wherein in a case where the first pressure chamber has a first pressure, the first and second urging members apply the first and second urging forces to the valve and in a case where the first pressure chamber has a second pressure that is higher than the first pressure, the first urging member does not apply the first urging force to the valve, whereas the second urging member applies the second urging force to the valve.

3. The pressure regulating unit according to claim 1, wherein at least a part of the first pressure chamber is formed of a first flexible member that is displaced according to the pressure in the first pressure chamber, and the first flexible member functions as the first urging member by applying, to the valve, an urging force as the first urging force that changes according to displacement of the first flexible member.

4. The pressure regulating unit according to claim 1, wherein at least a part of the second pressure chamber is formed of a second flexible member that is displaced according to the pressure in the second pressure chamber, and the valve adjusts the opening degree of the communication path according to the displacement of the second flexible member.

5. A liquid supplying apparatus comprising:

a liquid container for containing liquid; and a pressure regulating unit provided on a liquid supply path communicating between the liquid container and a liquid ejection head for ejecting liquid;

wherein the pressure regulating unit comprises:

a first pressure chamber capable of introducing liquid;

a second pressure chamber capable of leading out the liquid;

a communication path that allows the first pressure chamber and the second pressure chamber to communicate with each other;

a valve capable of adjusting an opening degree of the communication path; and an urging unit configured to apply an urging force to the valve, the urging force acting in a direction in which the communication path is closed and increasing according to a decrease in pressure in the first pressure chamber, the liquid supplying apparatus further comprising, at a position of the liquid supply path between the liquid container and the first pressure chamber in the pressure regulating unit, a pressurizing pump configured to pressurize the liquid contained in the liquid container so as to feed the liquid to the first pressure chamber.

6. The liquid supplying apparatus according to claim 5 further comprising a suction pump configured to suck the liquid in the liquid ejection head so as to return the liquid to the liquid container.

7. A liquid ejecting apparatus comprising:

the liquid supplying apparatus according to claim 5; and a liquid ejection head capable of ejecting liquid to be supplied from the liquid supplying apparatus.

8. An inkjet printing apparatus comprising:

the liquid supplying apparatus according to claim 5, the liquid supplying apparatus supplying ink serving as liquid;

an inkjet printing head configured to eject the ink to be supplied from the liquid supplying apparatus; and a moving unit configured to relatively move the inkjet printing head and a print medium.

9. A pressure regulating unit provided on a supply path communicating between a liquid container for containing liquid and a liquid ejection head for ejecting liquid, the unit comprising:

a first pressure chamber capable of introducing liquid;

a second pressure chamber capable of leading out the liquid;

a communication path that allows the first pressure chamber and the second pressure chamber to communicate with each other;

a valve capable of adjusting an opening degree of the communication path; and an urging unit configured to apply an urging force to the valve, the urging force acting in a direction in which the communication path is closed and increasing according to a decrease in pressure in the first pressure chamber, wherein the urging unit includes:

a first urging member configured to apply a predetermined first urging force that acts in the direction in which the communication path is closed and increases according to a decrease in pressure in the first pressure chamber; and a second urging member configured to apply a second urging force to the valve, the second urging force acting in the direction in which the communication path is closed, wherein at least a part of the first pressure chamber is formed of a first flexible member that is displaced according to the pressure in the first pressure chamber, and the first flexible member functions as the first urging member by applying, to the valve, an urging force as the first urging force that changes according to displacement of the first flexible member.

10. The pressure regulating unit according to claim 9, wherein in a case where the first pressure chamber has a first pressure, the first and second urging members apply the first and second urging forces to the valve and in a case where the first pressure chamber has a second pressure that is higher than the first pressure, the first urging member does not apply the first urging force to the valve, whereas the second urging member applies the second urging force to the valve.

11. The pressure regulating unit according to claim 9, wherein at least a part of the first pressure chamber is formed of a first flexible member that is displaced according to the pressure in the first pressure chamber, and the first flexible member functions as the first urging member by applying, to the valve, an urging force as the first urging force that changes according to displacement of the first flexible member.

12. The pressure regulating unit according to claim 9, wherein at least a part of the second pressure chamber is formed of a second flexible member that is displaced according to the pressure in the second pressure chamber, and the valve adjusts the opening degree of the communication path according to the displacement of the second flexible member.

* * * * *